United States Patent [19]

Angermann

[11] 4,265,006

[45] May 5, 1981

[54] DISPLAY AND BURIAL SYSTEM

[75] Inventor: Manfred E. Angermann, Lake Geneva, Wis.

[73] Assignee: Citadel Management Services, Inc., Lake Geneva, Wis.

[21] Appl. No.: 115,114

[22] Filed: Jan. 24, 1980

[51] Int. Cl.[3] ..... A61G 17/00

[52] U.S. Cl. ..... 27/14; 27/35

[58] Field of Search ..... 27/2, 14–18, 27/35

[56] References Cited

U.S. PATENT DOCUMENTS

| | | | |
|---|---|---|---|
| 2,963,766 | 12/1960 | Wallace | 27/15 X |
| 3,055,079 | 9/1962 | Flynn | 27/17 X |
| 3,613,189 | 10/1971 | Kirby | 27/35 |
| 3,810,282 | 5/1974 | Doggett | 27/35 |
| 4,151,630 | 5/1979 | Havey | 27/2 |

*Primary Examiner*—John D. Yasko

*Attorney, Agent, or Firm*—Wegner, Stellman, McCord, Wood & Dalton

[57] ABSTRACT

A display and burial system including a display base having an appearance similar to a casket base and having a supporting shelf along the upper perimeter thereof, a reusable casket-like movable lid unit removably supported by the supporting shelf to enable viewing of a body, and a cover unit positionable on said supporting shelf in place of the lid unit after viewing whereby the display base and cover unit provide a burial vault.

9 Claims, 5 Drawing Figures

57
50
51
58
56
21
2.
53
20
32
11
H
10
12
59
3.
55
44
52
73
36
35
40
42
41
30
23
31
45
33
34
70
72
71
22
5.
80
81

DISPLAY AND BURIAL SYSTEM

BACKGROUND OF THE INVENTION

This invention pertains to a display and burial system avoiding the need for an expensive, conventional casket and utilizing relatively inexpensive components suitably formed of reinforced plastic and with a display base subsequently usable as a vault base and having a reusable lid unit which is readily removed from the display base after viewing.

Conventional funeral practice includes the use of an expensive casket which is placed in a vault for burial. Considerable effort has been directed toward reducing funeral costs by various expedients including a reusable casket or a combined casket and vault structure. However, there are various drawbacks to these expedients.

An excellent substitute for conventional practice is disclosed in my prior U.S. Pat. No. 4,139,929 which discloses an integrated display and burial containment system wherein a display container is removably mounted in a display unit having an appearance similar to a casket. After the funeral service, the display container can be removed from the display unit and then associated with a suitable base and cover unit for subsequent burial, entombment, or cremation. This system requires the use of a relatively expensive display unit and involves manual handling of the display container in removal from the display unit and positioning thereof in a vault base prior to burial. A variation in the construction of a display unit as usable in this system is shown in my U.S. Pat. No. 4,177,543.

SUMMARY OF THE INVENTION

The invention disclosed herein primarily relates to a display and burial system having a display base usable during a funeral service which also functions as a vault base for subsequent burial, a reusable casket-like movable lid unit removably supported by the base and a cover unit forming a vault cover positionable on the base in place of the lid unit, whereby the display base and cover unit provide an enclosed vault structure and without any handling of a display container mounted within the display base.

More particularly, the display and burial system has a plastic base usable as a display base and a vault base and having a shelf extending around the upper periphery thereof and an upstanding flange extending along the outer edge of the shelf, a reusable lid unit removably associated with said base and having a perimetral frame on the underside thereof which rests on said shelf in a position controlled by said flange and with the lid unit including a lid member pivotally mounted on the frame for movement to a viewing position, and a vault cover unit positionable on said shelf after removal of the lid unit and in a position controlled by said flange to form, with said base, a burial vault.

Additional features of the invention relate to a lock bolt associated with the lid unit and operable from the rear thereof and engageable with a lid member to hold the latter in a viewing position, the use of the shelf and upstanding flange to define a trough for receiving sealant when the cover unit is supported by the shelf, and the shaping of the perimetral frame of the lid unit to have a part thereof forming a visible transition between said base and the lid member.

DESCRIPTION OF THE PREFERRED EMBODIMENT

Figures 1, 2, 3, 4, 5:
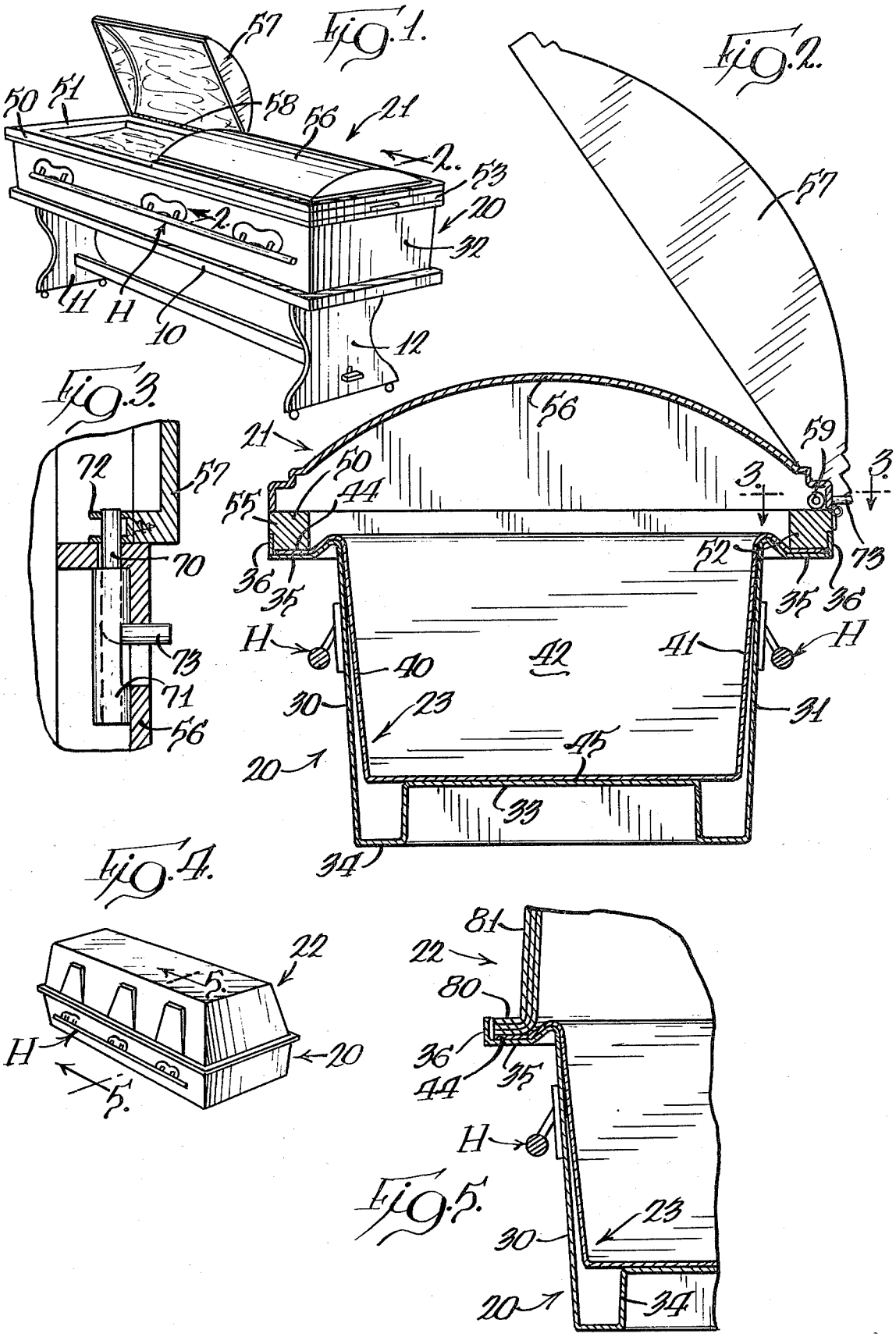
FIG. 1 is a perspective view of the display base and lid unit arranged for viewing.
FIG. 2 is a vertical section, taken generally along the line 2—2 in FIG. 1 and on an enlarged scale.
FIG. 3 is a fragmentary section, taken along the line 3—3 in FIG. 2 and on a further enlarged scale.
FIG. 4 is a perspective view of the display base associated with the cover unit to form a burial vault.
FIG. 5 is a fragmentary section, taken generally along the line 5—5 in FIG. 4, and on an enlarged scale.

The structure of display and burial system arranged for a funeral service and viewing is shown in FIG. 1 supported by a portable support table having a shelf 10 and depending legs 11 and 12.

The structure of the display and burial system includes a display base, indicated generally at 20, a lid unit, indicated generally at 21, and a cover unit, indicated generally at 22. The display base has a display container, indicated generally at 23, positioned therein. The display base 20, cover unit 22, and display container 23 are of the same construction as structures disclosed in my prior U.S. Pat. No. 4,139,929 and the disclosure thereof is incorporated herein by reference. More particularly, the display base 20, cover unit 22 and the display container 23 of this application correspond to the outer base 60, the second cover unit 65, and the display container 30 disclosed in my prior patent.

The display base 20 has front and rear walls 31 connected by side walls, one of which is shown at 32, and a bottom 33 provided with a peripheral depending leg 34 which rests on the support shelf 10 of the support table. The display base has support means in the form of a shelf 35 extending around the upper periphery thereof and an upstanding flange 36 extends along the outer edge of the shelf 35.

The display container 23 has front and rear walls 40 and 41 and end walls, one of which is shown at 42, and with an outwardly-extending peripheral flange 44 at the upper edge thereof which extends outwardly over the shelf 35 and supports the display container within the display base. Added support is provided by a bottom 45 of the display container resting on the bottom 33 of the display base. The display base 20 and display container 23 together define structure for holding a body, with there being suitable interior treatment to the display container and these parts are shown in perspective in FIG. 1. The exterior of the display base 20 has handle structure, indicated generally at H along the front and rear walls thereof, to facilitate handling and to provide an appearance more nearly similar to that of a conventional casket.

The lid unit 21 is a reusable structure which is removably associated with the display base and has a perimetral frame extending around the lower part thereof provided by lengths 50–53 of a member having a generally L-shaped cross section to rest upon the support shelf of the display base with the flange 44 of the display container interposed therebetween. An outwardly-extending part 55 of the frame member forms a visual transition between the upstanding flange 36 of the display base and a lid member of the lid unit. The lid member is shown as of a two-part structure having parts 56 and 57 which are mounted for pivotal movement independently of each other by hinge means, including a hinge 58 for the lid part 57 and a hinge 59 for the lid part 56. During viewing, the lid member 57, having suitable interior treatment, can be raised to the position shown in FIGS. 1 and 2 and retained in that position by a slidable lock bolt 70, shown in FIGS. 2 and 3. The slidable lock bolt 70 is slidably mounted in a member 71 attached to the part 56 of the lid member and can be extended outwardly to fit into a keeper 72 fitted to the underside of the part 57 of the lid member and as shown in FIG. 3. The lock bolt 70 can move between the locked position, shown in FIG. 3, and a retracted position by manually engaging an outturned end 73 of the lock bolt. This structure avoids the need for a pivotally-mounted rod which must be moved into a supporting position in association with the part 57 of the lid member, with a rod structure of this general type being shown in my prior U.S. Pat. No. 4,177,543.

After viewing, the part 57 of the lid member can be lowered to a position engaging the perimetral frame member 50. The entire lid unit 21 is then lifted from the display base 20 and the cover unit 22 is then placed on the display base whereby the display base and cover unit provide a vault structure for burial. This association of the units for burial is shown in FIG. 4 and the interengagement therebetween is shown in FIG. 5.

The cover unit 22 is formed of a multi-layer reinforced plastic structure, and with the front and rear walls and side walls thereof having an outwardly-turned lower end, as shown at 80, for the front wall 81 thereof. The outturned lower end is supported by the shelf 35 of the display base 20, in a manner similar to support of the lid unit, and the shelf, together with the upstanding flange 36, defines a trough which can receive sealant to completely seal the burial vault prior to burial. The flange 36, in addition to forming the trough, forms a guide for proper alignment of the cover unit 22 and also the lid unit 21 because of the coaction thereof with the perimetral frame member 50 of the lid unit as shown in FIG. 2.

With the structure disclosed herein, the display container 23 and display base 20 remain in association throughout a funeral and subsequent burial, with the avoidance of any handling of the display container relative to the display base. After the funeral, the lid unit 21 can be removed for reuse and the cover unit 22 substituted in place thereof whereby a burial vault is provided for burial or either entombment or cremation, if so desired. With the structure being predominantly of plastic, a relatively low cost unit is provided, with further reduction of cost because of the lid unit being reusable and certain of the components which provide a display function also providing part of the vault structure.

I claim:

1. A display and burial system including a display base having an appearance similar to a casket base and having support means along the upper perimeter thereof, a reusable casket-like movable lid unit removably supported by said support means to enable viewing of a body, and a cover unit positionable on said support means in place of said lid unit after viewing whereby the display base and cover unit provide an enclosed structure for subsequent entombment, cremation, or burial.

2. A display and burial system as defined in claim 1 wherein said support means is in the form of a shelf, said lid unit has a lower perimetral frame member engageable with said shelf, and a lid member pivotally mounted to said frame member for raising to a viewing position.

3. A display and burial system as defined in claim 2 including a slidable lock bolt engageable with the lid member to hold the latter in said viewing position.

4. A display and burial system as defined in claim 2 wherein said shelf has an upstanding flange along the outer edge thereof to confine said lid unit in a fixed position relative to the display base and to define a trough whereby sealant may be placed therein when the cover unit is supported by the shelf.

5. A display and burial system as defined in claim 1 wherein said display base and cover unit are of plastic material.

6. A display and burial system as defined in claim 1 including a removable display container within said display base and having an outwardly-extending peripheral flange resting on said support means.

7. A display and burial system having a display structure including a lid unit with a pair of lid members pivotal one with respect to the other to enable one lid member to move to a viewing position, and a lock bolt movably mounted at the rear of the lid unit and movable into engagement with the pivoted lid member to hold the latter in said viewing position.

8. A display and burial system comprising, a plastic base usable during viewing of a body and subsequently as a vault base for burial and having a shelf extending around the upper periphery of the base and with an upstanding flange along the outer edge of the shelf, a display container in said base, a reusable lid unit removably associated with said base and having a perimetral frame on the underside thereof which rests on said shelf in a position controlled by said flange, said lid unit including a lid member pivotally mounted on said frame for movement to a viewing position, and a vault cover unit positionable on said shelf after removal of the lid unit and in a position controlled by said flange to provide a burial vault.

9. A display and burial system as defined in claim 8 wherein said perimetral frame has a generally L-shaped cross section to have a part thereof overlapping said upstanding flange and forming a visible transition between said base and said lid member.

* * * * *